US010078299B1

(12) United States Patent
Tress et al.

(10) Patent No.: US 10,078,299 B1
(45) Date of Patent: Sep. 18, 2018

(54) SOLID STATE FUSER HEATER AND METHOD OF OPERATION

(71) Applicant: XEROX CORPORATION, Norwalk, CT (US)

(72) Inventors: Tab A. Tress, Henrietta, NY (US); Brian J. Gillis, Penfield, NY (US); Donald N. Rechlin, Pittsford, NY (US); Allen J. Thompson, Sodus, NY (US); Michael A. Fayette, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/462,520

(22) Filed: Mar. 17, 2017

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS

| | | | |
|---|---|---|---|
| 5,171,969 | A | 12/1992 | Nishimura et al. |
| 5,452,065 | A | 9/1995 | Bell |
| 5,493,373 | A | 2/1996 | Gundlach et al. |
| 6,423,941 | B1 | 7/2002 | Kanari et al. |
| 6,512,913 | B2 | 1/2003 | Hirst et al. |
| 6,580,883 | B2 | 6/2003 | Suzumi |
| 6,580,895 | B2 | 6/2003 | Hirst et al. |
| 6,721,530 | B2 | 4/2004 | Hirst et al. |
| 6,853,831 | B2 | 2/2005 | Hirst et al. |
| 7,058,346 | B2 | 6/2006 | Domoto et al. |
| 7,193,180 | B2 | 3/2007 | Cook et al. |
| 7,193,181 | B2 * | 3/2007 | Makihira ..... G03G 15/2042 219/216 |
| 7,228,082 | B1 | 6/2007 | Davidson et al. |
| 7,460,822 | B2 | 12/2008 | Potter et al. |
| 7,986,893 | B2 | 7/2011 | Condello |
| 8,121,528 | B2 | 2/2012 | Pawlik et al. |
| 8,213,849 | B2 | 7/2012 | Domoto et al. |
| 8,311,468 | B2 | 11/2012 | Qi et al. |

(Continued)

OTHER PUBLICATIONS

Jensen et al., U.S. Appl. No. 15/063,537, filed Mar. 8, 2016, entitled "Method for Temperature Leveling and/or Resistance Increase in Solid Heater".

*Primary Examiner* — David M Gray
*Assistant Examiner* — Michael Harrison
(74) *Attorney, Agent, or Firm* — Caesar Rivise, PC

(57) ABSTRACT

A fusing apparatus includes a heater that heats a fuser belt at a nip between the fuser belt and a pressure roll through which a sheet is conveyed to permanently fuse an image onto the sheet. The heater has a silicon wafer with a smooth side that contacts and heats the fuser belt at the nip, and circuitry at a second side, with the circuitry generating heat through the silicon wafer to heat the fuser belt. The circuitry may include a plurality of heat producing integrated circuits etched in the silicon wafer, with each heat producing integrated circuit configured to heat the fuser belt. Each integrated circuit may self-control its amount of heat produced to the silicon wafer, for example, by automatically switching back and forth between a heat-on-state and a heat-off-state to maintain a desired temperature within the silicon wafer that heats the fuser belt.

20 Claims, 6 Drawing Sheets

(56) References Cited

U.S. PATENT DOCUMENTS

| | | | | |
|---|---|---|---|---|
| 2007/0091161 | A1* | 4/2007 | Shoji | B41J 2/33585 347/200 |
| 2012/0148273 | A1* | 6/2012 | Shimura | G03G 15/2039 399/33 |
| 2017/0060054 | A1 | 3/2017 | Tress et al. | |

* cited by examiner

Analytical Properties

| Property | HP $Al_2O_3$ | Xerox $Al_2O_3$ | Aluminum Nitrade | Silicon |
|---|---|---|---|---|
| Thermal Conductivity (W mK) | 21 - 30 | 21 - 30 | 140 (AlN140)<br>180 (AlN180) | 156 (27C)<br>105 (127C)<br>80 (227C) |
| Diffusivity (cm^2/s) | | | | 0.86 (27C)<br>0.52 (127C)<br>0.37 (227C) |
| Thermal Coefficient of Expansion (um/mmC) | 7.6 | 6.6 | 3.6 (100C)<br>4.6 (300C)<br>5.2 (500C) | 2.616 (27C)<br>3.253 (127C)<br>3.614 (227C) |
| Specific Heat (J/Kg degC) | 836 | 880 | 800 (27C)<br>900 (127C)<br>1000 (227C) | 713 (27C)<br>785 (127C)<br>832 (227C) |
| Mass Density (Kg/m^3) | 3930 | 3700 | 3260 | 2329 |
| Elastic Modulas (GPa) | 410 | 320 | 318 | 129.5 - 186.5 |
| Poisons Ratio | 0.22 | 0.22 | 0.25 | 0.22 - 0.28 |

*FIG. 3*

SOLID STATE FUSER HEATER AND METHOD OF OPERATION

FIELD OF DISCLOSURE

This invention relates generally to electrostatographic image printing devices, and more particularly, to a solid state heater adapted to fuse an image onto a substrate in the printing devices.

BACKGROUND

In electrostatographic printing, commonly known as xerographic printing or copying, an important process step is known as "fusing". In the fusing step of the xerographic process, dry marking making material, such as toner, which has been placed in imagewise fashion on an imaging substrate, such as a sheet of paper, is subjected to heat and/or pressure in order to melt and otherwise fuse the toner permanently on the substrate. In this way, durable, non-smudging images are rendered on the substrates.

The most common design of a fusing apparatus as used in commercial printers includes two rolls, typically called a fuser roll and a pressure roll, forming a nip therebetween for the passage of the substrate therethrough. Typically, the fuser roll further includes, disposed on the interior thereof, one or more heating elements, which radiate heat in response to a current being passed therethrough. The heat from the heating elements passes through the surface of the fuser roll, which in turn contacts the side of the substrate having the image to be fused, so that a combination of heat and pressure successfully fuses the image as shown, for example, in U.S. Pat. Nos. 5,452,065; 5,493,373; and 7,460,822 B2.

Belt fusers are a type of fuser apparatus in which an endless belt is looped around a belt guide. A pressure roller presses a sheet having a toner image onto the fuser roller with the endless belt intervening between the pressure roller and the fuser roller. The fixing temperature for the toner image is controlled on the basis of the temperature of the fuser roller which may be detected by a sensor, such as a sensor in the loop of the belt and in contact with the fuser roller. A nip region is formed on a pressing portion located between the fuser roller and the pressure roller. The belt on a belt fuser is typically short as the fuser assembly is often enclosed within a cassette, and it is desirable that such a fuser cassette is as small as possible. Examples of belt fusers are shown, for example, in U.S. Pat. Nos. 7,228,082 B1, 7,986,893 B2 and 8,121,528 B2.

One configuration for radiating heat is a resistive heater that is adapted for heating a fuser belt with the heater comprising a heating board made of a ceramic, such as aluminum nitride, and a resistive trace formed over the heating board, with the heating board transferring heat from the resistive trace to the fuser belt. For example, resistive traces were provided on aluminum nitride surface, and heat was generated in the traces (the resistive layer) that had to then migrate from the resistive layer to the aluminum nitride surface and then from the aluminum nitride surface to heat the belt. It was this complex heat transfer that provided the heat to the fuser belt to facilitate the fusing function undertaken by the fuser belt. As shown in U.S. Pat. No. 7,193,180 B2, for example, a resistive heater is disclosed that is adapted for heating a fuser belt with the heater comprising a substrate, a first resistive trace formed over the substrate, and a second resistive trace formed so as to at least partially overlap the first trace. Another configuration for radiating heat inside the fuser roll or belt is to use a lamp configured to heat the heating board. These fuser solid heater elements are comprised of high cost base materials and inks manufactured in a time consuming process and require complex control strategies for axial temperature control and pre-warming to prevent belt stalling.

Metallic and ceramic materials are known to have excellent heat conduction properties and increased ability to withstand thermal breakdown when continuously exposed to elevated temperatures, it is these materials that are known to best suit themselves to use in high temperature heat generation elements such as those used in fuser units. In particular designs, heat rolls are added to adequately dissipate excess heat generated according to the heating process. However, for the reasons stated above, and for other reasons stated below which will become apparent to those skilled in the art upon reading and understanding the present specification, there is a need in the art for new heating element design in electrostatographic printing. It would be a benefit if such designs effectively mediate any need for heat rolls and other additional structures. There is also a need for improved independent control of a heating element.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The examples include a silicon wafer as a fuser belt heater, wherein the entire fuser belt heater can create the circuit path for energy production. The inventors have found that silicon wafer material exhibits similar qualities of heat conduction (FIG. 3) as present high cost ceramics used today. The silicon wafer heaters can withstand temperatures of 370° C.–380° C., which far exceeds typical fuser temperature requirements of about 150° C.-250° C. The silicon wafer heaters also have surface properties that would lend themselves to low wear rates between the silicon wafer and contact areas of the belt Through the use of semi-conductor technology the manufacture of silicon wafer heaters created through known manufacturing process or reclaim silicon wafers with the desired electrical conductivity exhibited (e.g., 0.005-100 ohm-cm) may be used. Additionally, circuitry may be integrated into the silicon wafers for use in self-regulation/control of temperature, which provides the benefit of removing this functional requirement from the printer of xerographic device. Through this design no thermal detection of the element is required thus eliminating external thermistors, control circuits, and thermal excursions. All of the silicon wafer circuit components (e.g., thermistors, resistors, diodes, transistors) may part of the actual heater element. Many of these circuits can be placed on or in a single silicon wafer element thus making a matrix of independently controlled temperature blocks. Due to the size of these elements, such silicon wafer heaters may be manufactured and operated at lower cost than prior fuser systems.

The foregoing and/or other aspects and utilities embodied in the present disclosure may be achieved by providing a printing device adapted to print an image onto a sheet. The printing device may include an imaging apparatus for processing and printing an image onto the sheet, an image development apparatus for developing the image, a transfer device for transferring the image onto the sheet, and a fusing apparatus. The fuser apparatus may include a fuser and a pressure roll. The fuser may include a heater and a fuser belt, with the heater having a silicon wafer with a first side configured to contact and heat the fuser belt at the nip, and circuitry attached to the silicon wafer at a second side distal the nip. The circuitry may be configured to generate heat through the silicon wafer to heat the fuser belt. The pressure roll may form a nip between the fuser belt and the pressure roll through which a sheet is conveyed to permanently fuse an image onto the sheet.

According to aspects illustrated herein, an exemplary fusing apparatus usable in a printing device may include a heater configured to heat a fuser belt at a nip between the fuser belt and a pressure roll through which a sheet is conveyed to permanently fuse an image onto the sheet, the heater having a silicon wafer with a first side configured to contact and heat the fuser belt at the nip, and circuitry attached to the silicon wafer at a second side distal the nip, the circuitry configured to generate heat through the silicon wafer to heat the fuser belt. The circuitry may include a plurality of heat producing integrated circuits, with each heat producing integrated circuit configured to heat a section of the silicon wafer from the heat producing integrated circuit to the first side of the silicon wafer. The heat producing integrated circuits may be formulated in the silicon wafer, for example, by etching, with each heat producing integrated circuit being an isolated resistive heating element. The heat producing integrated circuits may be fabricated in an array forming a solid state silicon wafer array heater having a length greater than a width of any sheet that traverses the nip. Each integrated circuit may be intentionally designed to self-control its amount of heat produced to the silicon wafer, for example, by automatically switching back and forth between a heat-on-state and a heat-off-state to maintain a desired temperature within the silicon wafer that heats the fuser belt.

According to aspects illustrated herein, a method for operating a fuser usable in a printing device includes conveying a sheet through the nip, heating the first side of a silicon wafer with a plurality of integrated circuits as circuitry attached to the silicon wafer, each of the plurality of integrated circuits configured to heat a section of the silicon wafer between the respective integrated circuit and the first side of the silicon wafer, and fusing an image onto the sheet at the nip with the heated silicon wafer via the belt. The heating step may include heating the first side of the silicon wafer with a plurality of integrated circuits etched into the silicon wafer, the plurality of integrated circuits being arranged in an array having a length greater than a width of the sheet. The method may also include the integrated circuits self-controlling the amount of heat applied by each of the integrated circuits automatically switching back and forth between a heat-on-state and a heat-off-state to maintain a desired temperature within the silicon wafer that heats the fuser belt.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and:

FIG. 3 is a table describing analytical properties of aluminum oxide, aluminum nitride and silicon;

DETAILED DESCRIPTION

Figure 1:
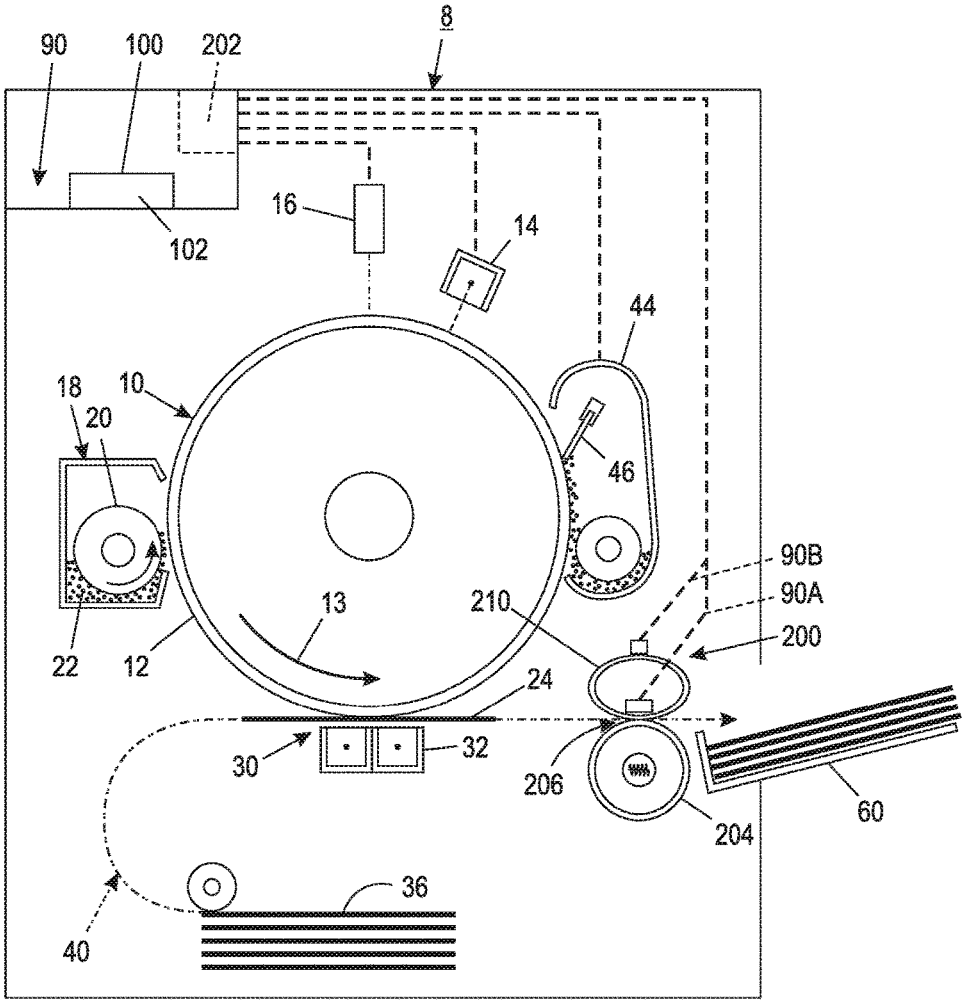
FIG. 1 is an elevational view showing relevant elements of an exemplary toner imaging electrostatographic machine including an embodiment of the fusing apparatus of the present disclosure.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

The disclosed printer and fuser system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. It will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein in their entireties where appropriate for teachings of additional or alternative details, features, and/or technical background. What is well known to those skilled in the art need not be described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

When referring to any numerical range of values herein, such ranges, are understood to include each and every number and/or fraction between the stated range minimum and maximum. The same applies to each other numerical property and/or elemental range set forth herein, unless the context clearly dictates otherwise.

The terms "print media", "print substrate", "print sheet" and "sheet" generally refers to a usually flexible physical sheet of paper, polymer, Mylar material, plastic, or other suitable physical print media substrate, sheets, webs, etc., for images, whether precut or web fed.

The term "printing device", "imaging machine" or "printing system" as used herein refers to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

The term "circuitry" as used herein refers to any structure (s), whether in the form of one or more discrete elements or otherwise, having predetermined electrical properties for obtaining a desired electrical output or physical result such as, but not limited to, heat output in a given area.

Referring now to FIG. 1, an electrostatographic or toner-printing device 8 is shown. As is well known, a charge receptor or photoreceptor 10 having an imageable surface 12 and rotatable in a direction 13 is uniformly charged by a charging device 14 and imagewise exposed by an exposure device 16 to form an electrostatic latent image on the surface 12. The latent image is thereafter developed by a development apparatus 18 that, for example, includes a developer roll 20 for applying a supply of charged toner particles 22 to such latent image. The developer roll 20 may be of any of various designs, such as, a magnetic brush roll or donor roll, as is familiar in the art. The charged toner particles 22 adhere to appropriately charged areas of the latent image. The surface of the photoreceptor 10 then moves, as shown by the arrow 13, to a transfer zone generally indicated as 30. Simultaneously, a print sheet 24 on which a desired image is to be printed is drawn from sheet supply stack 36 and conveyed along sheet path 40 to the transfer zone 30.

At the transfer zone 30, the print sheet 24 is brought into contact or at least proximity with a surface 12 of photoreceptor 10, which at this point is carrying toner particles thereon. A corotron or other charge source 32 at transfer zone 30 causes the toner image on photoreceptor 10 to be electrostatically transferred to the print sheet 24. The print sheet 24 is then forwarded to subsequent stations, as is familiar in the art, including the fusing station having a high precision-heating and fusing apparatus 200 of the present disclosure, and then to an output tray 60. Following such transfer of a toner image from the surface 12 to the print sheet 24, any residual toner particles remaining on the surface 12 are removed by a toner image baring surface cleaning apparatus 44 including, for example, a cleaning blade 46.

As further shown, the printing device 8 includes a controller or electronic control subsystem (ESS), indicated generally by reference numeral 90 which is preferably a programmable, self-contained, dedicated mini-computer having a central processor unit (CPU), electronic storage 102, and a display or user interface (UI) 100. At UI 100, a user can select one of the pluralities of different predefined sized sheets to be printed onto. The conventional ESS 90, with the help of sensors, a look-up table 202 and connections, can read, capture, prepare and process image data such as pixel counts of toner images being produced and fused. As such, it is the main control system for components and other subsystems of the printing device 8 including the fusing apparatus 200 of the present disclosure.

Figure 2:
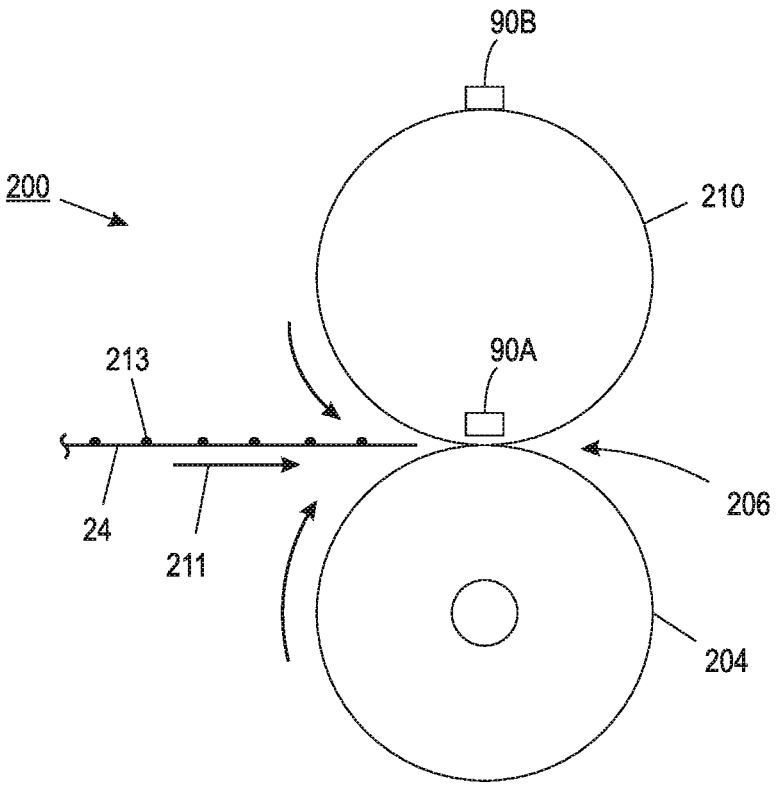
FIG. 2 is an enlarged schematic side view of the fusing apparatus of FIG. 1.

Referring now to FIG. 2, the fusing apparatus 200 of the present disclosure is illustrated in detail and is suitable for uniform and quality heating of unfused toner images 213 in the electrostatographic printing device 8. As illustrated, fusing apparatus 200 includes a rotatable pressure member or roll 204 that is mounted forming a fusing nip 206 with a fuser roll member such as a fuser belt 210. Heater 90A is positioned in contact with the inner diameter of fuser belt 210. Heater 90B is optional as required by design configuration. A copy sheet 24 carrying an unfused toner image 213 thereon can thus be fed in the direction of arrow 211 through the fusing nip 206 for high quality fusing.

While not being limited to any particular configuration of a fusing system, the disclosed examples may be particularly usable in belt-type fuser system in which a fuser belt is driven around a belt support (e.g., belt guide, rollers) and a stationary heat source to impart heat into the fuser belt surface. According to the disclosed examples, instead of having, for example, a quartz lamp or ceramic heating board that may be mounted in a manner to provide radiant heating to the fuser surface, a silicon wafer with electrical circuitry (e.g., electrodes), which may be in the form of arrays of integrated circuits (ICs), a larger scale semi-continuous resistive element or any of the like configuration, may be pressed against the belt at a point at which the belt forms a nip with a comparatively softer opposing presser member (e.g., pressure roll), the nip having a nip length according to the fusing requirements established for the image forming device of which this belt-type fuser unit may constitute an integral component. The fuser belt is urged to translate across the surface of the silicon wafer heater element according a copy sheet and interaction with the pressure roll.

Examples of the fuser belt 210 can include at least one layer comprised of polymeric materials. For example, the fuser belt 210 can include a base layer forming an inner surface, an intermediate layer overlying the base layer, and an outer layer forming an outer surface overlying the intermediate layer. The inner layer can be composed of polyimide, or the like; the intermediate layer of a conformable material, such as silicone; and the outer layer of a fluoropolymer having low-friction properties, such as polytetrafluoroethylene (Teflon®). The fuser belt 210 has a thickness and material composition that allows it be elastically deformed in the fusing apparatus 200.

In other examples, the fuser belt 210 can include a metal or metal alloy (e.g., steel, stainless steel). The metal or metal alloy can be coated with an elastomeric material (e.g., silicone) forming an intermediate layer. A material with low-friction properties (e.g., polytetrafluoroethylene (PFTE), perfluoroalkoxy (PFA)) can be applied over the intermediate layer to form an outer layer of the fuser belt 210.

An additional benefit of silicon as the heater material is the opportunity to generate circuitry on the material itself. This allows use of a silicon wafer as a solid state fuser heater. The term "solid state" as used herein refers to those circuits or devices built entirely from solid materials in which the electric current is confined to solid elements and compounds within the solid material engineered specifically to switch and amplify the current. Solid state, as referred to in this document, may include a semi-conductive substrate with active and passive components. The active components include transistors and diodes, which are normally associated terms when describing a "solid state" device such as a radio. Devices with only passive components (e.g., resistors, capacitors, inductors) though made from solid materials, are not considered "solid state" as these devices do not have any amplifying or rectifying capabilities. These passive devices, which includes the related art fuser heaters discussed above, have been used with vacuum tubes for decades prior to the introduction to the solid state device—the transistor.

Figure 4:
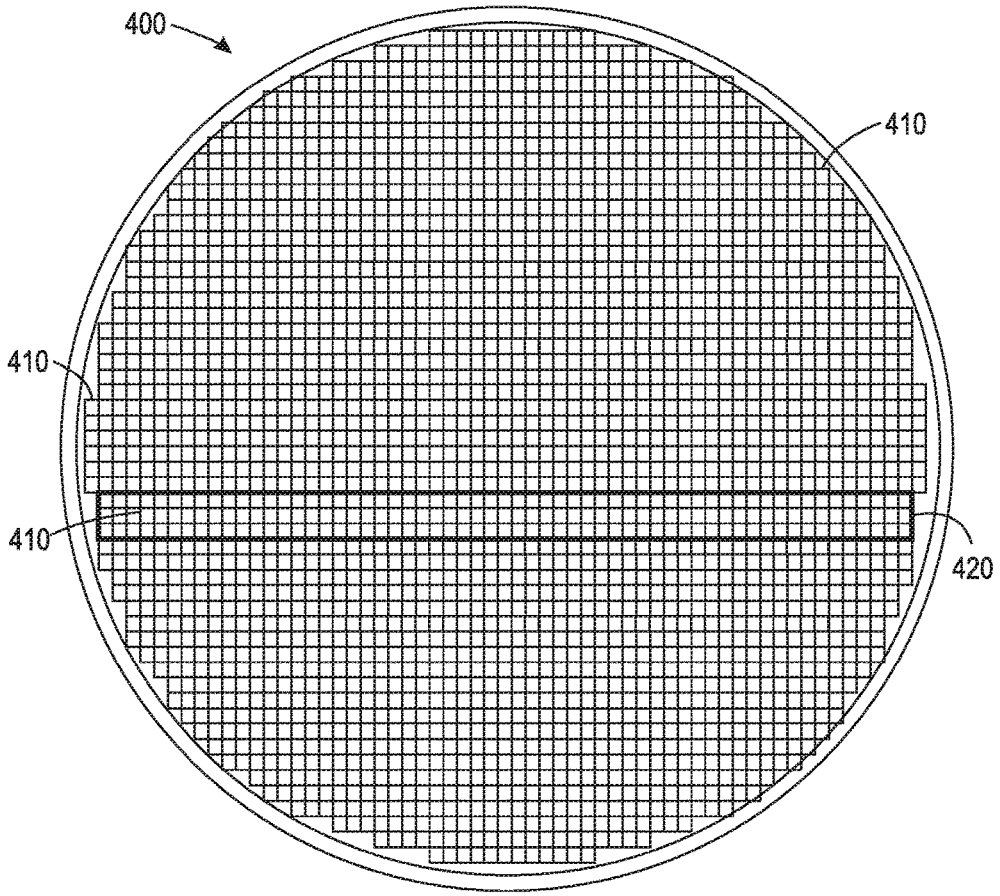
FIG. 4 is top view of a silicon wafer in accordance with exemplary embodiments.

FIG. 4 is an exemplary top view of a silicon wafer 400 that includes a plurality of dies including a die 410. As used herein, the term "wafer" refers to a thin slice of electronic-grade semiconductor material, such as a silicon crystal, used in the fabrication of "dies" such as integrated circuits and other microelectronic devices. As is well-known in the art, a wafer serves as the substrate that dies are fabricated in and on using fabrication processing steps such as doping or ion implantation, etching, deposition of various materials, and photolithographic patterning. In FIG. 4 each of the dies is represented by a tiny rectangle within a potential fabrication area 420 where dies can be fabricated. The rectangle 410 represents one particular die. As used herein, the term "die" refers to a small block of semiconducting material, on which a given functional circuit may be fabricated. Typically, multiple dies are produced in and/or on the wafer 400. The terms "die", "microchip", "chip" and "integrated circuit" are used interchangeably herein, with an "integrated circuit" referring to an electronic circuit of electronic components (e.g., resistors, transistors, capacitors) connected on a small piece of semiconducting material to achieve a common goal.

The silicon wafer 400 may be cut (or "diced") into many pieces. In particular, the wafer may be cut into a group or array 420 of the dies 410 that form an exemplary fuser heater, with the dies being isolated heating elements. The array 420 may be separated (or "diced"), for example, by scribing and breaking, by mechanical sawing (normally with a machine called a dicing saw) or by laser cutting as is well-known in the art. Other arrays of dies 410 may also be diced from the wafer 400, with the size of the arrays not limited to any particular size or number of dies 410.

It is understood that the dimensions of the heater elements are by example only, and do not limit the scope to any particular dimension. In accordance with the examples, the heater 90A includes a silicon wafer array 420 of dies. The array 420 may have a length across of about 350 mm and a width up and down of about 12 mm. In the examples, the array 420 may have a length longer than the width of any print sheet 24 printed on by the printing device to at least cover the width of the print sheet fed through the fuser nip 206. The heater may include one array 420 that may extend along the length of the heater 90A to sufficiently heat the fuser belt 210 to fuse the print sheet across the width of the print sheet 24 fed in the direction of arrow 211 through the fusing nip 206. Silicon wafers are only now reasonably manufactured in a size that allows consideration of silicon wafer arrays at least about 350 mm in length. The heater may also include a plurality of arrays 420 that combined extend along the length of the heater to ensure heating of the entire print sheet for fusing.

Still referring to FIG. 4, the wafer 400 has a smooth side configured to contact the internal surface of the fuser belt 210 and heat the fuser belt at the nip 206 (FIG. 2), and the circuitry (e.g., integrated circuits (ICs)) mounted to a rough side of the wafer opposite the smooth side, with the circuitry configured to generate heat through the smooth side of the wafer to heat the fuser belt. The silicon wafer between the integrated circuits and the smooth side may be less than about 1 mil thick, and due to the high conductivity of the silicon material the heat generated from the individual circuits pass easily through to the fuser belt 210. The silicon material also provides the advantage of tending to render the localized heating of the silicon surface more uniform. The wafer array 420 is a solid-state heater as including heat producing circuits built entirely from solid materials in which the charge carriers are confined entirely within the silicon wafer.

There are myriad ways by which the electrical circuitry may be configured and/or formulated with the silicon wafer array 420. Individual electrical circuits may appear similar to conventional circuitry by which electrical traces are provided to heat conventional heater component surfaces. Combinations of resistive elements and arrays may be provided, which may be self-generating and/or self-controlling. A benefit over the conventional fuser heat bar components is in the ability of the individually "pixilated" electrical circuits as heat producing integrated circuits etched into the silicon wafer 400. The heat generating circuits, instead of determining ways to dissipate the heat to avoid thermal circuits, are designed to produce (generate) heat with the dissipation mechanism being in the transfer of the heat to the fuser belt.

Figure 5:
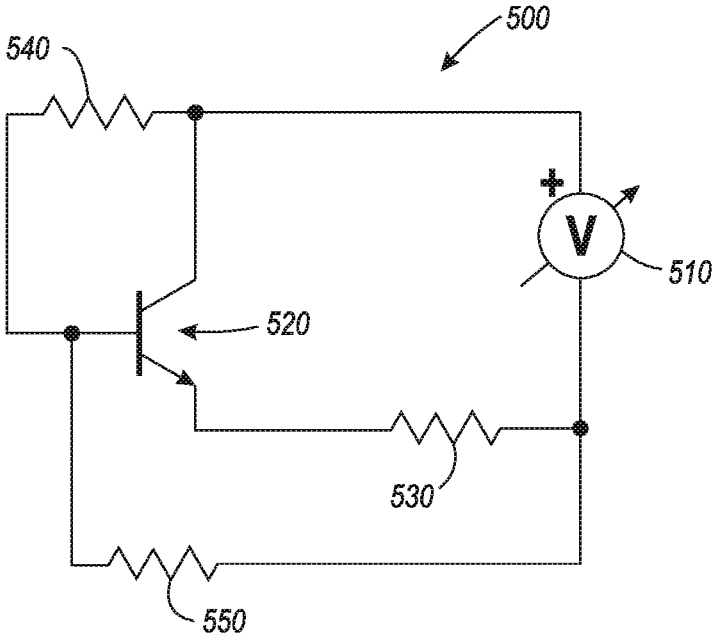
FIG. 5 is a schematic of an integrated circuit heating element in accordance with exemplary embodiments.

An integrated circuit may be fabricated on the silicon wafer array 420 that may define a particular fusing temperature setpoint (e.g., about 150° C.-250° C.). The circuit may be usable to generate the energy through the selected material to heat the belt for fusing the image. FIG. 5 is a schematic of an exemplary integrated circuit 500 that may be fabricated in or on the silicon wafer 400 to form one of the dies 410. The circuit 500 is a heating element that converts electricity into heat through resistive or Joule heating. Electric current from a voltage source 510 passes through a transistor 520 (e.g., NPN transistor) and encounters load resistor 530 (e.g., 5000), resulting in heating of the circuit. The integrated circuit 500 is also intentionally designed to self-control or self-regulate its amount of heat produced to the silicon wafer. As can be seen in FIG. 5, the heating of the circuit 500 continues while the transistor 520 is switched on.

The circuit 500 includes thermistors 540, 550. While not being limited to a particular theory, in the exemplary integrated circuit 500, the thermistor 540 is a Positive Temperature Coefficient (PTC) thermistor (e.g., 10K Ω) that increases resistance as temperature rises, and the thermistor 550 is a Negative Temperature Coefficient (NTC) thermistor (e.g., 1K Ω) that decreases resistance as temperature rises. The PTC thermistor 540 may be set high, for example, 10K Ω to create a low level of current flow and avoid forming a secondary heating methodology when the PTC transistor is effectively off. This allows the transistor 520 to work until the NTC thermistor 550 resistance reaches or drops below parity with the warming load resistor 530, as discussed in greater detail below.

Initially, with the NTC thermistor 550 set higher than the resistor 530, the transistor 520 is saturated and turned "on" and the circuit 500 and surrounding silicon is heated. As the circuit temperature rises, the NTC thermistor 550 resistance decreases. Eventually, with the rising temperature, the resistance of the NTC thermistor 550 drops below the resistance of load resistor 530. When this occurs, the transistor 520 is switched to "off" and current does not flow over the resistor 530. Instead, current flows from thermistor 540 to thermistor 550. The circuit 500 cools from its heated temperature without current flowing through the resistor 530, which in turn increases the resistance of the NTC thermistor 550 as temperature drops. This increase in the NTC thermistor resistance continues until the resistance rises above the set resistance of the resistor 530, whereupon the transistor 520 is switched back to "on", and the circuit 500 heats up as current again flows through the resistor 530. Of course, with the rising circuit temperature, the NTC thermistor resistance drops again, eventually below the set resistance of the resistor 530, which turns "off" the transistor. This automatic switching back and forth between a heat-on-state and a heat-off-state keeps the integrated circuit 500 temperature oscillating about a desired temperature, such as a fusing temperature for the heater 90A (FIG. 2). Thus, this self-controlling feature of the integrated circuit 500 may maintain a desired temperature within the silicon wafer to heat the fuser belt.

Each individual heat generating circuit 500 among a plurality of individual heat generating circuits may be self-controlling in that it is designed to operate at a particular temperature and to be self-regulating with respect to that individual temperature according to a design of the solid state heater element. In embodiments, electrical biasing may be applied to, for example, change a particular temperature set point for each of the heat generating elements in order to account, as indicated above, for differences in desired heat input capability base, for example, on differing sizes, compositions, and materials with respect to the images are formed to be fixed on the paper media by the fuser apparatus.

Figure 6:
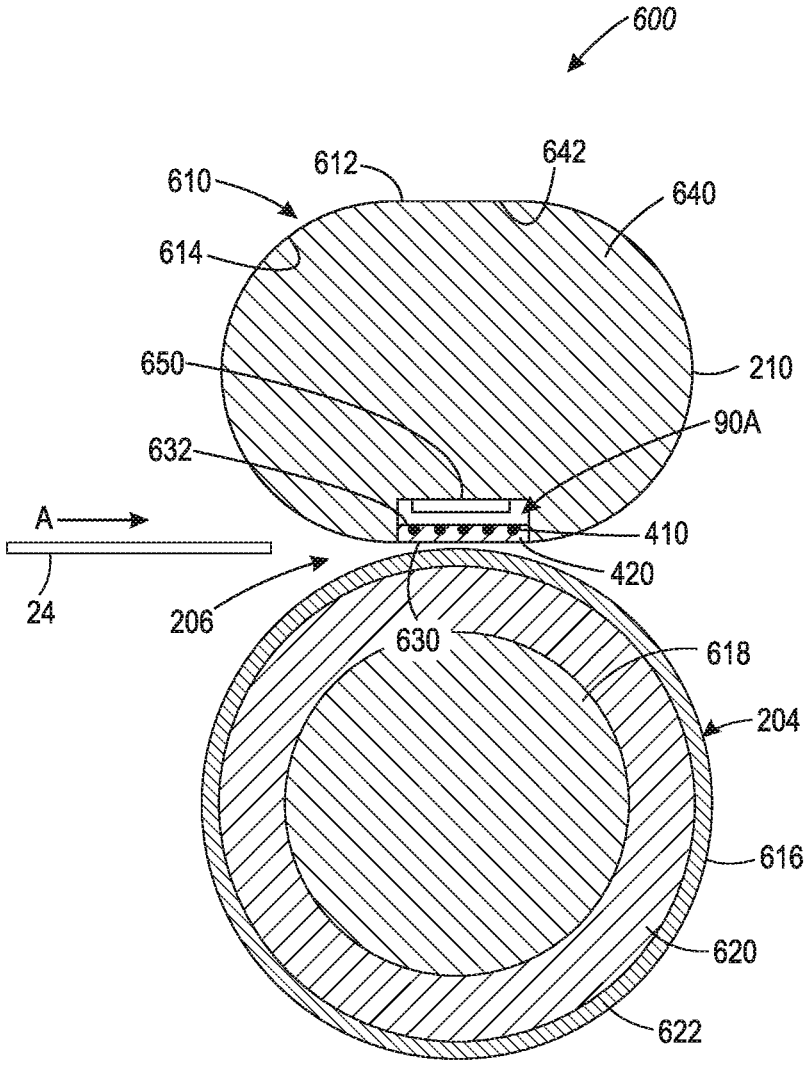
FIG. 6 is a cross-sectional view of a fusing apparatus in accordance with exemplary embodiments.

FIG. 6 depicts an exemplary fusing apparatus 600 usable in a printing device similar to the fusing apparatus 200 of FIGS. 1 and 2. Embodiments of the fusing apparatus 600 shown in FIG. 6 can be used, for example, in place of the fusing apparatus 200 in the printing device 8. The printing device 8 can be used to produce prints from various media, such as coated or uncoated (plain) paper sheets, having various sizes and weights.

The fusing apparatus 600 includes the continuous fuser belt 210 with an outer surface 612 and inner surface 614, and the pressure roll 204 with an outer surface 616 contacting the outer surface 612. The outer surface 616 of the pressure roll 204 and outer surface 612 of the fuser belt 210 form the nip 206. In examples, the pressure roll 204 is a drive roll and the fuser belt 210 is free-spinning and driven by engagement with the pressure roll 204. The pressure roll 204 may rotate clock-wise to cause the belt to rotate counter-clockwise and convey media though the nip 206.

The illustrated pressure roll 204 includes a core 618, an inner layer 620 provided on the core, and an outer layer 622 provided on the inner layer. The core 618 can include a metal, metal alloy, or durable plastic; the inner layer 620 of an elastic material, such as silicone; and the outer layer 622 of a low-friction material, such as Teflon®.

The fusing apparatus 600 further includes a fuser 610 having the heater 90A located inside of the fuser belt 210. The heater 90A includes the silicon wafer array 420 of dies 410 stationary and extending axially (longitudinally) along the fuser belt 210. In examples, the wafer array 420 is located at the nip 206 and configured to heat the fuser belt 210 rotated to the nip. The wafer array 420 includes a smooth side 630 with a belt-facing surface and an opposite rough side 632, with the belt-facing surface configured to contact the inner surface 614 of the fuser belt 210. The silicon wafer array 420 heats the fuser belt 210 by thermal conduction. The smooth side 630 belt-facing surface can be planar, and substantially the entire belt-facing surface may contact the inner surface 614 of fuser belt 210. The smooth side 630 made of silicon is known to have a low coefficient of friction, which minimizes friction between the belt-facing surface of the silicon wafer array 420 and the inner surface 614 of the fuser belt.

The fuser belt 210 is supported by a fuser housing 640 located inside the fuser belt. The fuser housing 640 extends along the axial direction (longitudinal direction) of the fuser roll 210, and includes an outer guide surface 642 contacting a portion of the inner surface 614 of the fuser belt 210. The fuser housing 640 can be comprised of a material having low thermal conductivity (i.e., a thermal insulator) to reduce heat transfer from the silicon wafer array 420 and fuser belt 210 to the fuser housing 640.

The silicon wafer array 420 may be configured in a manner such that the belt-facing surface may be on an order, for example, of about 12 mm in a nip-width direction by as much as 350 mm axially in a belt-transverse direction. The silicon wafer array 420 may be mounted to the fuser housing 640, which may then provide structural support to the array 420 and the fuser belt 210, while also providing support for wiring components 650 as an interface between electrical and control circuitry of the fusing apparatus, and the integrated circuits 410 in the silicon wafer array 420. The fuser housing 640 may be mounted in such a manner that it provides necessary structural support and opposition to the force applied by the pressure roll 204 so as to apply appropriate nip pressure at the nip 206. Thus, the fuser housing 640 may press the silicon wafer array 420 against the inner surface 614 of the fuser belt 210 in a manner that facilitates the imparting of the heat therethrough.

During operation, print media 24 is fed to the nip 206. FIGS. 2 and 6 show print media traveling in the process direction A toward the nip 206. The print media 24 can be, for example, a paper sheet with at least one toner image. At the nip 206, the outer surface 616 of the pressure roll 204 and outer surface 612 of the fuser belt 210 contact opposite surfaces of the print media. The fuser belt 210 supplies sufficient thermal energy to the print media 24 to heat the marking material to a sufficiently-high temperature to fix the marking material to the print media. In examples, a silicon wafer array 420 heater has a smooth side configured to contact and heat the fuser belt 210 at the nip, and circuitry attached to the silicon wafer at a rough side distal the nip. The circuitry generates heat through the silicon wafer to heat the smooth side of the silicon wafer and the fuser belt to a fusing temperature and fixes the image onto the print media. The circuitry may include a plurality of integrated circuits formulated in the silicon wafer array as pixelated heating circuits, with each of the integrated circuits configured to heat a section of the silicon wafer between the respective integrated circuit and the first side of the silicon wafer. The integrated circuits may automatically self-controlling the heat applied by each of the plurality of integrated circuits to the silicon wafer, for example, by automatically switching back and forth between a heat-on-state and a heat-off-state to maintain a desired temperature within the silicon wafer that heats the fuser belt.

Previously, a skilled artisan would not readily consider silicon wafer designed to be applicable to a high temperature environment as there is a potential for thermal breakdown in silicon-based integrated circuits if the heat is not controlled. As noted above, through extensive experimentation it was determined that medium-great silicon wafers have an acceptable heat bearing capacity that allows them to be considered for such use. In typical silicon-based IC circuit design, design parameters such as keeping heat generation to a minimum and facilitating heat removal were known to avoid heat buildup leading to thermal breakdown of the silicon-based IC circuits. In this regard, it runs opposed to the normal consideration regarding typical silicon-based integrated circuits to drive such silicon-based integrated circuits according to designed elevated temperature profiles required for fusing.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A fusing apparatus usable in a printing device, the fusing apparatus comprising a heater configured to heat a fuser belt at a nip between the fuser belt and a pressure roll through which a sheet is conveyed to permanently fuse an image onto the sheet, the heater having a silicon wafer with a first side configured to contact and heat the fuser belt at the nip, and circuitry attached to the silicon wafer at a second side distal the nip, the circuitry configured to generate heat through the silicon wafer to heat the fuser belt, the circuitry including a plurality of heat producing integrated circuits, each heat producing integrated circuit configured to heat a section of the silicon wafer from the heat producing integrated circuit to the first side of the silicon wafer.

2. The fusing apparatus of claim 1, wherein the heat producing integrated circuits are etched into the silicon wafer.

3. The fusing apparatus of claim 1, wherein each heat producing integrated circuit includes an isolated resistive heating element.

4. The fusing apparatus of claim 1, the plurality of heat producing integrated circuits being arranged in an array having a length greater than a width of the sheet.

5. The fusing apparatus of claim 1, each integrated circuits configured to self-control its amount of heat produced to the silicon wafer.

6. The fusing apparatus of claim 5, the integrated circuits self-controlling the amount of heat produced by each of the integrated circuits automatically switching back and forth between a heat-on-state and a heat-off-state to maintain a desired temperature within the silicon wafer that heats the fuser belt.

7. The fusing apparatus of claim 1, wherein the heater is a solid state heater.

8. The fusing apparatus of claim 1, wherein the first side of the silicon wafer is smoother than the second side of the silicon wafer.

9. A printing device adapted to print an image onto a sheet, comprising:

an imaging apparatus for processing and printing an image onto the sheet;

an image development apparatus for developing the image;

a transfer device for transferring the image onto the sheet;

a fuser having a heater and a fuser belt, the heater having a silicon wafer with a first side configured to contact and heat the fuser belt at the nip, and circuitry attached to the silicon wafer at a second side distal the nip, the circuitry configured to generate heat through the silicon wafer to heat the fuser belt, the circuitry including a plurality of heat producing integrated circuits, each heat producing integrated circuit configured to heat a section of the silicon wafer from the heat producing integrated circuit to the first side of the silicon wafer; and a pressure roll that forms a nip between the fuser belt and the pressure roll through which a sheet is conveyed to permanently fuse an image onto the sheet.

10. The printing device of claim 9, wherein the heat producing integrated circuits are etched into the silicon wafer.

11. The printing device of claim 9, wherein each heat producing integrated circuit includes an isolated resistive heating element.

12. The printing device of claim 9, the plurality of heat producing integrated circuits being arranged in an array having a length greater than a width of the sheet.

13. The printing device of claim 9, each integrated circuit configured to self-control its amount of heat produced to the silicon wafer.

14. The printing device of claim 13, the integrated circuits self-controlling the amount of heat produced by each of the integrated circuits automatically switching back and forth between a heat-on-state and a heat-off-state to maintain a desired temperature within the silicon wafer that heats the fuser belt.

15. The printing device of claim 9, wherein the heater is a solid state heater.

16. The printing device of claim 9, wherein the first side of the silicon wafer is smoother than the second side of the silicon wafer.

17. A method for operating a fuser usable in a printing device, the fuser having a fuser belt configured to form a nip between the fuser belt and a pressure roll through which a sheet is conveyed to permanently fuse an image onto the sheet, the fuser including a heater having a silicon wafer with a first side configured to contact and heat the fuser belt at the nip, and circuitry attached to the silicon wafer at a second side distal the nip, the circuitry configured to generate heat through the silicon wafer to heat the fuser belt, the method comprising:

a) conveying a sheet through the nip;

b) heating the first side of the silicon wafer with a plurality of integrated circuits as the circuitry attached to the silicon wafer, each of the plurality of integrated circuits configured to heat a section of the silicon wafer between the respective integrated circuit and the first side of the silicon wafer; and c) fusing an image onto the sheet at the nip with the heated silicon wafer via the belt.

18. The method of claim 17, wherein the step b) includes heating the first side of the silicon wafer with a plurality of integrated circuits etched into the silicon wafer, the plurality of integrated circuits being arranged in an array having a length greater than a width of the sheet.

19. The method of claim 17, further comprising the integrated circuits automatically self-controlling the heat applied by each of the plurality of integrated circuits to the silicon wafer.

20. The method of claim 19, the integrated circuits self-controlling the amount of heat applied by each of the integrated circuits automatically switching back and forth between a heat-on-state and a heat-off-state to maintain a desired temperature within the silicon wafer that heats the fuser belt.

* * * * *